US006247975B1

(12) United States Patent
Cue

(10) Patent No.: US 6,247,975 B1
(45) Date of Patent: Jun. 19, 2001

(54) MULTI-PIECE ELECTRICAL RECEPTACLE TERMINAL

(75) Inventor: Robert J. Cue, South Lyon, MI (US)

(73) Assignee: Framatome Connectors Interlock, Inc., Westland, MI (US)

( * ) Notice: Subject to any disclaimer, the term of this patent is extended or adjusted under 35 U.S.C. 154(b) by 0 days.

(21) Appl. No.: 09/211,189

(22) Filed: Dec. 14, 1998

(51) Int. Cl.[7] ..... H01R 13/187
(52) U.S. Cl. ..... 439/845; 439/852
(58) Field of Search ..... 439/843, 845, 439/851, 852, 853, 858, 861, 862, 846, 847, 849, 856, 857, 863

(56) References Cited

U.S. PATENT DOCUMENTS

| | | | | |
|---|---|---|---|---|
| 3,370,265 | | 2/1968 | Berg | 439/843 |
| 5,217,382 | | 6/1993 | Sparks | 439/161 |
| 5,427,552 | | 6/1995 | Zielinski et al. | 439/845 |
| 5,427,553 | * | 6/1995 | Tsuji | 439/851 |
| 5,433,629 | | 7/1995 | Yagi et al. | 439/843 |
| 5,716,245 | * | 2/1998 | Kameyama et al. | 439/851 |

* cited by examiner

*Primary Examiner*—Neil Abrams
*Assistant Examiner*—Michael C. Zarroli
(74) *Attorney, Agent, or Firm*—Perman & Green, LLP

(57) ABSTRACT

A multi-piece electrical receptacle terminal comprising a frame and a spring. The frame has a receptacle section for a male terminal. The spring is movably captured within the receptacle section. The spring comprises a first resiliently flexible arm, a second resiliently arm and a contact section. The contact section is disposed between the first arm and the second arm. The first arm is shorter than the second arm.

14 Claims, 3 Drawing Sheets

MULTI-PIECE ELECTRICAL RECEPTACLE TERMINAL

BACKGROUND OF THE INVENTION

1. Field of the Invention

The present invention relates to electrical receptacle terminals and, more particularly, to a multi-piece electrical receptacle terminal.

2. Prior Art

U.S. Pat. No. 5,217,382 discloses a two-piece electrical receptacle terminal for receiving a male terminal. U.S. Pat. No. 5,433,629 discloses a female terminal which has a contact spring within the terminal. U.S. Pat. No. 3,370,265 discloses an electrical connector with a socket for a pin connector and a spring held within the socket.

SUMMARY OF THE INVENTION

In accordance with a first embodiment of the present invention, a multi-piece electrical receptacle terminal is provided. The multi-piece electrical receptacle terminal comprises a frame and a spring. The frame has a receptacle section for a male terminal. The spring is movably captured within the receptacle section of the frame. The spring comprises a first resilient flexible arm, a second resilient flexible arm and a contact section. The contact section is disposed between the first arm and the second arm. The first arm is shorter than the second arm.

In accordance with a second embodiment of the present invention, a multi-piece electrical receptacle terminal is provided. The multi-piece electrical receptacle terminal comprises a frame and a spring. The frame has a receptacle section for a male terminal. The receptacle section has a front end with an aperture formed therein. The aperture at the front of the receptacle section is adapted to receive a male portion of the male terminal. The spring is movably captured within the receptacle section. The spring has a general leaf spring configuration. The spring comprises a front spring arm connected to a rear spring arm by a contact section between the front spring arm and the rear spring arm. The front spring arm is shorter than the rear spring arm. The front spring arm is disposed between the rear spring arm and the front end of the receptacle section. The front and rear spring arms contact the receptacle section to bias the spring against stop surfaces on the receptacle section. The bias of the spring against the stop surfaces on the receptacle section preloads the spring.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
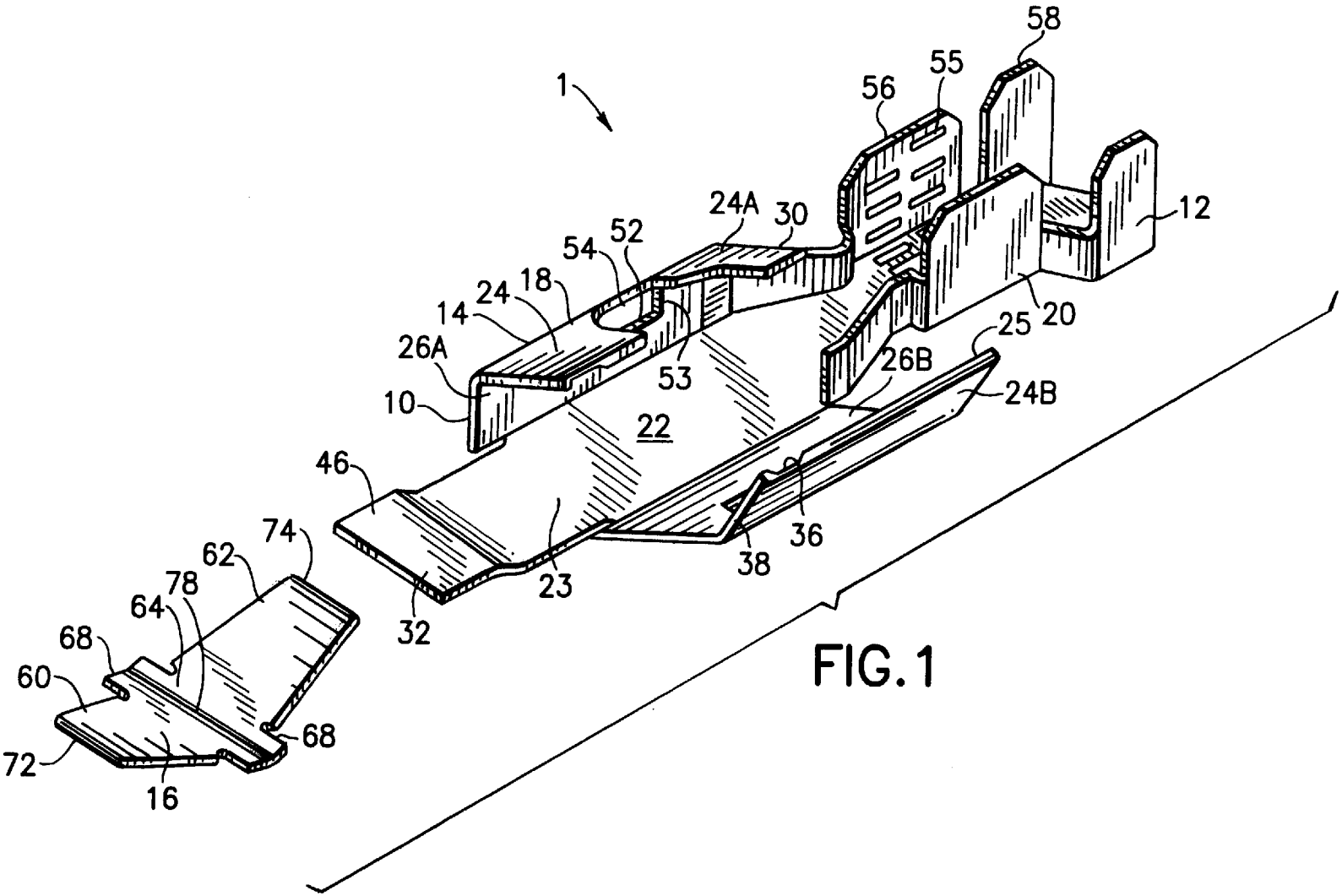
FIG. 1 is an exploded perspective view of an electrical receptacle terminal incorporating features of the present invention, the electrical receptacle terminal being shown with the receptacle section partially formed.

Referring to FIG. 1, there is shown an exploded perspective view of a multi-piece electrical receptacle terminal 1 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The electrical receptacle terminal 1, shown in FIG. 1 is generally adapted to be used with a male terminal 201 (see FIG. 4) having a pin contact with a length of about 6 mm or more. However, the features of the present invention described herein are equally applicable to electrical receptacle terminals used with other size male terminals. The electrical receptacle terminal 1 is mated to the male terminal at the front end 10 of the receptacle terminal 1. The rear end 12 of the terminal 1 is adapted to connect the terminal 1 to a conductor (not shown). The electrical receptacle terminal 1 generally comprises a terminal body 14 and a spring 16. The spring 16 is mounted to the terminal body 14.

Figure 2:
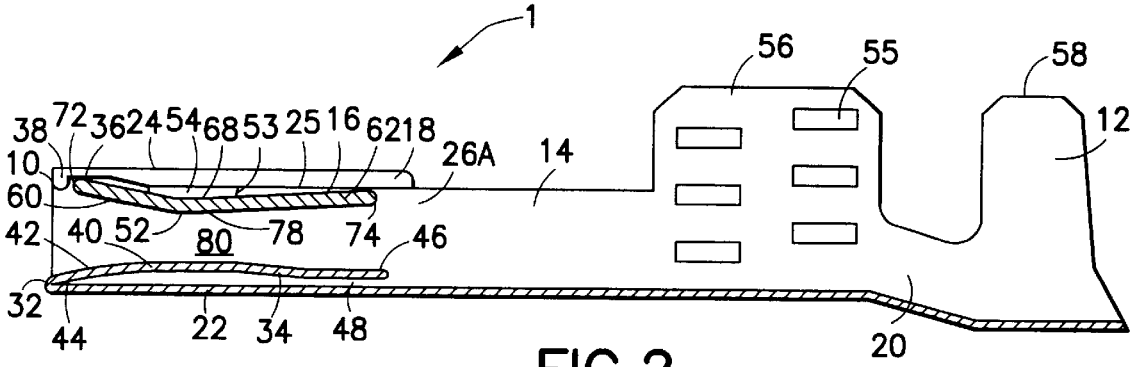
FIG. 2 is a cross-sectional elevation view of the electrical receptacle terminal in FIG. 1, now with the receptacle section being shown in a final configuration and before insertion of a contact into the receptacle section.

Referring now to FIGS. 1 and 2, the terminal body 14 is a one piece member made from sheet metal or other conductive material. The terminal body 14 has a front receptacle section 18 and a rear conductor connection section 20. The front receptacle section 18 is a shell adapted to admit therein a pin contact 200 of the male terminal 201 (see FIG. 4). Preferably, the receptacle section 18 has a generally rectangular tubular shape. An open seam in the receptacle section 18 extends from the front 10 of the terminal 1 to the rear 30 of the receptacle section. In alternate embodiments, the receptacle section may have any other suitable tubular shape (such as a tube with a generally polygonal cross-section or a generally circular cross-section) to admit therein a pin contact of a male terminal and may be either seamless or have a closed seam. The receptacle section 18 has a bottom 22, a top 24 and two side walls 26A, 26B connecting the top 24 to the bottom 22. The top 24 and bottom 22 span between the side walls 26A, 26B of the receptacle section 18. In the preferred embodiment, the open seam is located in the top 24 of the receptacle section 18 substantially by-secting the top into two sections 24A, 24B. Alternatively, the open seam may be located in any other side of the receptacle section.

Still referring to FIGS. 1 and 2, the bottom 22 of the receptacle section 18 is substantially flat and has a tab 32 extending therefrom at the front end 10 of the electrical receptacle terminal 1. The tab 32 is bent over itself at the front end 10 of the electrical receptacle terminal 1 so that the tab 32 extends within the receptacle section 18 (see FIG. 2). The bent over tab 32 and the bottom 22 of the receptacle section 18 form a resiliently flexible general clip configuration which acts as a lower spring 34 within the receptacle section 18. The tab 32 forms the spring arm 42 of the lower spring 34 and the bottom 22 of the receptacle section forms the base 44 of the spring 34. As seen best in FIG. 2, the tab 32 is stamped to form a raised contact area 40. In the preferred embodiment, the tab 32 terminates in a snubber flange 46. The snubber flange 46 is vertically offset from the contact area 40 towards the bottom 22 of the receptacle section 18. A gap 48 is formed between the flange 46 and the bottom 22 of the receptacle section 18 (see FIG. 2). The gap 48 allows the spring arm 42 of the spring 34 to be resiliently deflected down from its home position. The flange 46 snubs against the bottom 22 of the receptacle section 18 to limit the downward deflection of the spring arm 42 (see FIG. 4). In alternate embodiments, the snubber flange may be formed at any other suitable location on the tab of the lower spring (such as the sides of the tab). In still other alternate embodiments, the bottom of the receptacle section may have a raised section which forms a deflection snubber for the lower spring.

Still referring to FIG. 2, the top 24 of the receptacle section 18 has a groove 36 formed therein. The groove 36 is formed in the inner surface 25 of the top 24 of the receptacle section 18. The groove 36 extends laterally between the side walls 26A, 26B proximate the front 10 of the receptacle terminal 1. The top 24 of the receptacle section 18 has an inner lip 38 at the front 10 of the terminal 1 which borders the groove 36. Each side wall 26A, 26B has a vertical slot 54 formed therein (see FIG. 2). In the preferred embodiment, each slot 54 has a lower edge 52 and extends upwards from the lower edge substantially to the top 24 of the receptacle section 18 (see also FIG. 1). Each slot 54 has a generally tapered shape with the side edges 53 of the slot 54 flaring outward from the lower edge 52 to the top of the slot. The lower edge 52 of the slot 54 may be bent preferably inwards (not shown) to form a seating surface at the bottom of the slot. In alternate embodiments, the slots in the side walls of the receptacle section may have any other suitable shape.

The rear conductor connection section 20 of the electrical receptacle terminal 1 has a general channel configuration adapted to receive a conductor (not shown) therein. The conductor connection section has an inner pair 56 and an outer pair 58 of crimp tabs. The inner pair of crimp tabs 56 are set closer together than the outer pair 58. The inner pair of crimp tabs 56 are provided with raised surfaces 55 between the tabs as shown in FIG. 1. The terminal 1 is connected to the conductor by placing the conductor in the connection section 20 and crimping the inner pair 56 and outer pair 58 of crimp tabs. The inner pair 56 are crimped around the conducting core (not shown) and the outer pair 58 are crimped around the insulation (not shown) of the conductor.

Figure 3:
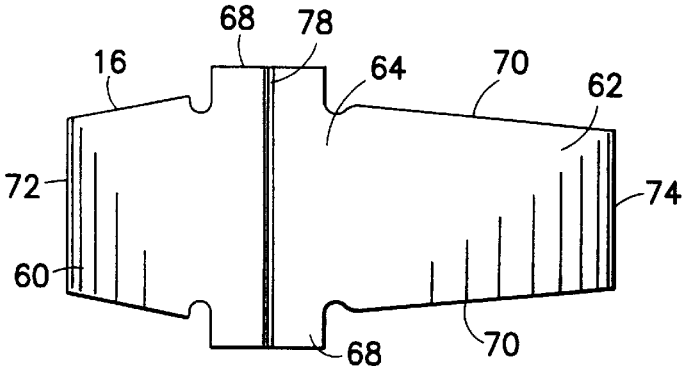
FIG. 3 is a top plan view of the spring for the electrical receptacle terminal shown in FIG. 1.

Referring now to FIGS. 1 and 3, the spring 16 of the electrical receptacle terminal 1 is stamped from sheet metal or other conductive material. The spring 16 has a general leaf spring configuration. When viewed from a top plan view, the spring 16 has a generally cruciform shape (see FIG. 3). The spring 16 comprises a front cantilever arm 60, a rear cantilever arm 62 and a contact section 64 located between the front and rear arms 60, 62. The front and rear arms 60, 62 are cantilevered from the contact section 64. The front and rear cantilever arms 60, 62 are asymmetric, with the front arm 60 being shorter than the rear arm 62 (see also FIG. 2). The front cantilever arm 60 is inclined at a higher angle relative to the base 78 of the contact section 64 than the rear cantilever arm 62. Thus, the contact section 64 is disposed closer to the front edge 72 of the spring 16 than to the rear edge 74. In the preferred embodiment, the front and rear cantilever arms 60, 62 have a generally tapered shape, each arm being wider at the interface with the contact section 64 and tapering in respectively to the front and rear edges 72, 74 of the spring 16 (see FIG. 3). In alternate embodiments, the front and rear arms of the spring may have any other suitable shape (such as a generally rectangular shape) Furthermore, as seen in FIG. 3, the front and rear edges 72, 74 of the spring 16 are substantially straight. However, in alternate embodiments, the front and rear edges of the spring may be scalloped so that the front and rear cantilever arms respectively may have a generally forked configuration. Examples of springs having scalloped front and rear edges are disclosed in U.S. patent application Ser. No. 09/124,140, filed on Jul. 29, 1998 for an "Electrical Terminal Connector" which is incorporated herein by reference in its entirety. The spring 16 has two detents, a side tabs 68 which project laterally from the longitudinal edges 70 of the spring 16. The side tabs 68 are located generally at the base 78 of the contact section 64 of the spring 16. The side tabs 68 have an appropriate length and width to be admitted into the vertical slots 54 in the side walls 26A, 26B of the receptacle section 18 when the spring 16 is mounted to the terminal body 14.

Referring now to FIG. 2, the spring 16 is mounted to the body 14 of the electrical receptacle terminal 1 within the receptacle section 18. The spring 16 is positioned and orientated within the receptacle section 18 to form an upper spring opposite the lower spring 34. The spring 16 is installed in the receptacle section 18 with the base 78 down and the front and rear edges 72, 74 up. The side tabs 68 of the spring 16 extend into the vertical slots 54 in the side walls 26A, 26B of the receptacle section 18. The spring 16 is captured vertically between the lower edges 52 of the slots 54 in the side walls 26A, 26B and the top 24 of the receptacle section 18. The side tabs 68 are seated on the lower edges 52 of the vertical slots 54. The front and rear edges 72, 74 of the spring 16 rest against the top 24 of the receptacle section 18. The front edge 72 of the spring 16 is located in the groove 36 in the top 24 of the receptacle section. The front and rear cantilever arms 60, 62 of the spring 16 have a predetermined length and inclination to provide the spring 16 with an appropriate uncompressed height such that when the spring is captured between the top 24 and the lower edges 52 of the slots 54 of the receptacle section, the spring is compressed to develop a predetermined preload. Thus, the cantilever arms 60, 62 contact the top 24 of the receptacle section 18 to bias the side tabs 68 against the lower edges 52 of the slots 54 in the side walls 26A, 26B of the receptacle section 18 and preload the spring 16. The spring 16 is held in the receptacle section 18 by the side tabs 68 located in the vertical slots 54. The vertical slots 54 provide limited horizontal or side play for tabs 68. The tabs 68 are free to move upward within the vertical slots 54 when the base 78 of the spring 16 is resiliently deflected upwards. Thus, the spring 16 is movably captured within the receptacle section 18 of the terminal body 14. A gap 80 is formed between the base 78 of the spring 16 and the spring arm 42 of the lower spring 34 when the tabs 68 of the spring 16 are seated against the lower edges 52 of the slots 54.

The electrical receptacle terminal 1 may be fabricated generally as follows. The description of the fabrication of the electrical receptacle terminal 1 is made with reference to FIG. 1 which shows the receptacle terminal 1 in a partially fabricated state. The terminal body 14 and spring 16 of the electrical receptacle terminal 1 may be initially stamped or cut from sheet metal. The stamped work piece for the terminal body (not shown) has a central spar supporting a number of side tabs with the appropriate shape to form the receptacle section 18 and rear conductor connection section 20 of the terminal body 14. The center spar of the stamped work piece forms the bottom 23 of the terminal body 14 (see FIG. 1). The tab 32 for the lower spring 34 of the receptacle section 18 projects from the front of the center spar. To form the terminal body 14 from the stamped work piece, first the tab 32 is stamped to form the offset snubber flange 46. Afterwards, the tab 32 is bent over itself to form the lower spring 34 of the receptacle section 18 (see FIG. 2). Then, the side tabs on the center spar are folded to form the side walls 26A, 26B and top half sections 24A, 24B of the receptacle section 18. The tabs which form the rear conductor connection section 20 are also bent at this time. Prior to bending the side walls 26A, 26B, the tabs which later makeup the side walls are stamped to fashion the slots 54. Simultaneous with the formation of the side walls 26A, 26B and top half sections 24A, 24B of the receptacle section 18, and in any event before bending the side walls 26A, 26B into their final position to form the shell of the receptacle section 18, the stamped work piece for the spring 16 is also formed into the leaf spring shape. The spring 16 is then positioned in the still open receptacle section and the side walls 26A, 26B are bent to their upright position to form the seamed shell of the receptacle section 18. As the side walls 26A, 26B are bent upright, the side tabs 68 of the leaf spring 16 enter the corresponding vertical slots 54 in the walls 26A, 26B to capture the spring 16 within the receptacle section 18. Finally, the top half sections 24A, 24B are bent down to close the receptacle section 18 with the spring 16 captured therein. The bending of the top half sections 24A, 24B compresses the spring 16, now trapped between the lower edges 52 of the slots 54 and the formed top 24 of the receptacle section 18, to preload the spring 16 inside the receptacle section.

Figure 4:
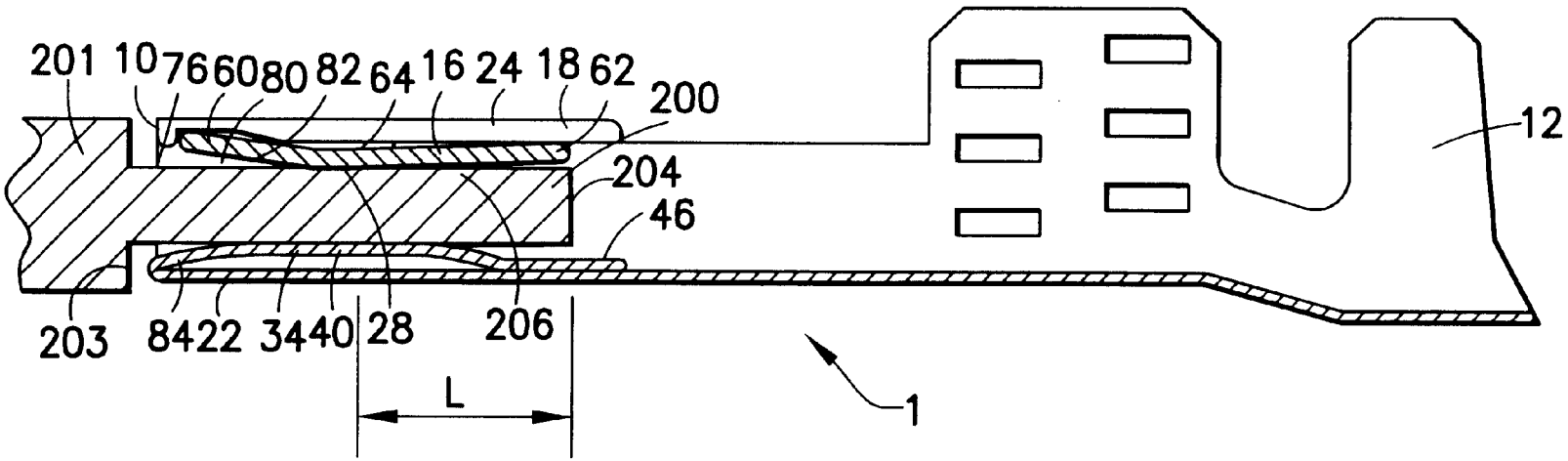
FIG. 4 is a second cross-sectional elevation view of the electrical receptacle terminal shown in FIG. 1, after insertion of a pin contact into the receptacle section.

As seen in FIG. 4, the electrical receptacle terminal 1 is mated to the male terminal 201 by inserting its male or pin contact 200 into the receptacle section 18 through the opening 76 in the front end 10 of the receptacle terminal 1. Within the receptacle section, the pin contact is inserted into the gap 80 between the spring 16 and the lower spring 34 of the receptacle section. When the pin contact is inserted into the gap 80, the contact 200 acts against a cam on ramp surface 82 of the front arm 60 of the spring 16 and the cammed surface 84 of the spring arm 42 on the lower spring 34 resiliently deflecting the springs 16, 34 away from each other. As the pin contact 200 continues to be inserted into the receptacle section 18, the contact 200 overcomes the preload on the spring 16 raising the tabs 68 off the lower edges 52 (see FIG. 2) and upwards within the slots 54. Thus, as seen in FIG. 4, the spring arm 42 of the lower spring 34 is deflected downward and the spring 16 is compressed upward against the top 24 of the receptacle section 18 by the pin contact 200 located in gap 80. Conversely, the compressed upper and lower springs 16, 34 cooperate to clamp the pin contact 200 therebetween. The male terminal 201 is fully inserted into the receptacle section 18 when the front end 10 of the terminal 1 abuts a stop surface 203 on the male terminal 201. When the male terminal 201 is inserted fully into the receptacle section 18, the leading edge 204 of the pin contact 200 has moved past the base 78 of the contact section 64 of the spring 16. Thus, when the male terminal 201 is fully inserted, the leading edge 204 of the pin contact 200 is located in the receptacle section 18 to the rear of the contact section 64 of the spring 16. The contact section 64 of the spring 16 acts against a side 206 of the pin contact 200. As seen in FIG. 4, the shorter front arm 60 of the spring 16 places the contact section 64 of the spring 16 closer to the front 10 of the terminal 1, moving the contact section 64 away from the leading edge 204 of the pin contact 200. This positional bias of the contact section 64 of the spring towards the front 10 of the terminal increases the engagement length formed between the leading edge 204 of the pin contact 200 and the contact section 64 of the spring 16. In the preferred embodiment, the front cantilever arm 60 of the spring 16 has an appropriate length to place the contact section 64 sufficiently close to the front 10 of the terminal 1 and away from the pin edge 204 to provide an engagement length "L" (see FIG. 4) of about 1 mm or more for a pin contact having a length of about 6 mm or more. The longer rear cantilever arm 62 of the spring 16 has an appropriate length to generally compensate for the increase in stiffness of the shorter front arm 60 and maintain the flexibility of the spring 16 generally commensurate with a spring of equal length having arms of symmetrical length.

The present invention provides a multi-piece electrical receptacle terminal 1 with a spring 16 having asymmetric cantilever arms 60, 62. This asymmetric shape provides a spring 16 with a contact section 64 which is moved forwards in the receptacle section 18 of the terminal 1, and in addition the spring 16 has a predetermined preload in the receptacle section. Furthermore, the asymmetric shape of the spring 16 increases the engagement length of the pin contact 200 in the receptacle section 18 of the terminal without incurring a substantial increase in stiffness of the spring.

Electrical receptacle terminals having a spring movably captured in a receptacle section of the terminal are know in the art. The springs in the receptacle terminals of the prior art have a length appropriate to the length of the receptacle section, but with equal length arms. Correspondingly, in the prior art, the contact section of a spring in a receptacle section of a given length is placed generally in the middle of the receptacle section. A consequence of this placement of the spring contact section is that when the receptacle terminals of the prior art are used with male terminals having a pin contact length of about 6 mm, the engagement length between the pin contact and spring contact section is less than desirable. Many users of electrical receptacle terminals specify a pin engagement length of about 1 mm or more as a requisite performance dimension for receptacle terminals. In addition, the ever present drive to reduce the size of electrical contacts (in order to realize the benefits in cost and power reduction inherent to smaller contacts) has resulted in male contact pins of smaller diameter or thickness. Necessarily, the length of the male contact pins has also shrunk (in keeping with the reduction in thickness) to maintain the overall structural integrity of the thinner contact pins (long contact pins with a thin cross-section have low strength and are readily susceptible to damage). However, the contact sections of the prior art springs are not located sufficiently close to the front of the receptacle sections to provide an engagement length of about 1 mm or more when used with small male contacts which have proliferated in number.

The present invention overcomes this problem. The present invention provides a receptacle terminal 1 with a spring 16 which has asymmetric cantilever arms to increase the engagement length between the pin contact 200 and the spring contact section 64. The present invention does not merely increase engagement length by reducing the length of the spring to move the contact section 64 closer to the front 10 of the terminal 1. This would significantly increase the stiffness of the spring 16. Increases in spring stiffness are highly undesirable, especially in terminals for small/thin male contacts, because stiff springs may damage the male contact when the contact is inserted into the terminal. The high force which must be generated by the thin contact during insertion to deflect the stiff spring may damage the contact. The present invention avoids this because the increase in engagement length arises from the asymmetric length and inclination between the front and rear arms 60, 62 of the spring 16 which maintains the spring stiffness generally commensurate with the stiffness of a spring of similar overall length having arms of equal length.

Although the preferred embodiment of the present invention has been described with specific reference to a multi-piece electrical receptacle terminal adapted for use with a pin contact having a length of about 6 mm or more, the features of the present invention are equally applicable to multi-piece receptacle terminals used with contacts of different size. It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A multi-piece electrical receptacle terminal comprising:

a frame with a receptacle section for a male terminal; and a spring movably captured within the receptacle section, the spring comprising two asymmetric cantilevered resiliently flexible arm sections, and a contact section from which the asymmetric resiliently flexible arm sections depend, wherein a first resiliently flexible arm from the resiliently flexible arm sections is shorter than a second resiliently flexible arm from the resiliently flexible arm sections.

2. A multi-piece electrical receptacle terminal as in claim 1, wherein the first resiliently flexible arm and the second resiliently flexible arm are cantilevered from the contact section.

3. A multi-piece electrical receptacle terminal as in claim 1, wherein the receptacle section has a front end with an opening therein through which a pin portion of the male terminal is inserted into the receptacle section, and wherein the spring is held in the receptacle section so that when the pin portion of the male terminal is inserted into the receptacle section and contacts the spring, the pin portion first contacts the first resiliently flexible arm of the spring.

4. A multi-piece electrical receptacle terminal as in claim 1, wherein the spring is stamped to have a general leaf spring shape.

5. A multi-piece electrical receptacle terminal as in claim 1, wherein the receptacle section has a pair of side walls connected to a first side spanning between the side walls, each of the side walls having a slot formed therein, and wherein the spring has two detents with each of the detents being located in the slot of a corresponding one of the side walls of the receptacle section.

6. A multi-piece electrical receptacle terminal as in claim 5, wherein the resiliently flexible arms urge the detents against support edges of the slots in the side walls to preload the spring, and wherein when a pin portion of the male terminal is inserted into the receptacle section and compresses the spring, the detents move within the corresponding slots generally towards the first side of the receptacle section.

7. A multi-piece electrical receptacle terminal comprising:

a frame with a receptacle section for a male terminal, the receptacle section having a front end with an aperture therein adapted to receive a male portion of the mail terminal; and a spring movably captured within the receptacle section, the spring having a general leaf spring configuration and comprising a front spring arm connected to a rear spring arm by a contact section between the front spring arm and the rear spring arm;

wherein the front spring arm is shorter than the rear spring arm and is disposed between the rear spring arm and the front end of the receptacle section, and wherein the front and rear spring arms contact the receptacle section biasing the spring against stop surfaces on the receptacle section to preload the spring;

and wherein the receptacle section has a side plate with a recess formed into the side plate, the recess defining a groove in an inside surface of the side plate, a front end of the front spring arm being seated inside the groove in the inside surface of the side plate of the receptacle section.

8. A multi-piece electrical receptacle terminal as in claim 7, wherein each spring arm has a support surface at a distal end of each spring arm, the support surface of each spring arm being seated against a side of the receptacle section.

9. A multi-piece electrical receptacle terminal as in claim 8, wherein the spring has a pair of tabs projecting from opposite sides of the spring, the tabs being located in slots formed in the receptacle section and resting against corresponding edges of the slots which form the stop surfaces against which the spring is preloaded.

10. A multi-piece electrical receptacle terminal as in claim 7, wherein the front spring arm has a cam surface which cooperates with a leading edge on the male portion of the male terminal to compress the spring when the male portion is inserted into the receptacle section.

11. A multi-piece electrical receptacle terminal as in claim 7, wherein the spring movably captured in the receptacle section forms a first contact spring in the receptacle section, and wherein the receptacle section includes a tab which forms a second contact spring in the receptacle section, the second contact spring being disposed opposite the first contact spring to sandwich the male portion of the male terminal inside the receptacle section between the first contact spring and the second contact spring.

12. A multi-piece electrical receptacle terminal as in claim 7, wherein the receptacle section has a lip projecting inwards from the side plate of the receptacle section.

13. A multi-piece electrical receptacle terminal as in claim 12, wherein the lip borders the groove in the inner surface of the side plate of the receptacle section.

14. A multi-piece electrical receptacle terminal comprising:

a frame with a receptacle section for a male terminal; and a spring movably captured within the receptacle section, the spring comprising a first resiliently flexible arm, a second resiliently flexible arm and a contact section disposed between the first arm and the second arm, wherein the first arm is shorter than the second arm;

wherein the receptacle section has a pair of side walls connected to a first side spanning between the side walls, each of the side walls having a slot formed therein, and the spring has two tabs with each of the tabs being located in the slot of a corresponding one of the side walls of the receptacle section, and wherein the resiliently flexible arms urge the tabs against support edges of the slots in the side walls to preload the spring, and when a pin portion of the male terminal is inserted into the receptacle section and compresses the spring, the tabs move within the corresponding slots generally towards the first side of the receptacle section.

* * * * *